US005582009A

United States Patent [19]

Brieschke

[11] Patent Number: 5,582,009

[45] Date of Patent: Dec. 10, 1996

[54] AIR-OIL INTENSIFIER

[75] Inventor: Todd M. Brieschke, Temperance, Mich.

[73] Assignee: Aries Engineering Company, Inc., Toledo, Ohio

[21] Appl. No.: 578,901

[22] Filed: Dec. 27, 1995

[51] Int. Cl.[6] ..... F15B 7/00

[52] U.S. Cl. ..... 60/560; 60/567; 60/576; 92/86

[58] Field of Search ..... 60/560, 563, 567, 60/575, 574, 576, 577, 583; 92/86

[56] References Cited

U.S. PATENT DOCUMENTS

| | | | |
|---|---|---|---|
| 3,059,433 | 10/1962 | Hirsch | 60/576 |
| 3,293,994 | 12/1966 | Napolitano | 92/86 |
| 3,426,530 | 2/1969 | Georgelin | 60/567 |

*Primary Examiner*—F. Daniel Lopez

*Attorney, Agent, or Firm*—MacMillan, Sobanski & Todd

[57] ABSTRACT

An intensifier type of fluid actuator includes a body including a first manifold connected by a first tube to a second manifold to define an intensifier chamber, a third manifold connected by a second tube to the second manifold to define a reservoir chamber, and a fourth manifold connected by a third tube to the third manifold to define a work chamber. A reservoir piston is disposed within the reservoir chamber and has an outer surface in sealing and sliding engagement with the second tube. The reservoir piston includes an inner surface defined by a central opening formed therethrough which extends from a first end of the reservoir piston adjacent to the second manifold to a second end of the reservoir piston adjacent to the third manifold. A passageway is formed in the reservoir piston which extends from the inner surface to the outer surface, thereof. A check valve assembly is disposed within the reservoir piston which permits the one-way flow of fluid from the passageway to the first end of the reservoir piston.

14 Claims, 4 Drawing Sheets

AIR-OIL INTENSIFIER

BACKGROUND OF THE INVENTION

This invention relates in general to fluid actuators for causing movement of a piston relative to a cylinder. In particular, this invention relates to an air/oil intensifier type of fluid actuator having an improved structure for maintaining the separation of the air and oil within the intensifier cylinder.

Fluid actuators are well known devices which are adapted to generate mechanical movement in response to the application of pressurized fluid, such as air or oil. A basic fluid actuator includes a hollow cylinder having a piston slidably disposed therein. The outer circumferential surface of the piston slidably sealingly engages the inner circumferential surface of the cylinder so as to divide the interior of the cylinder into first and second chambers. When a pressurized fluid is supplied to the first chamber and the second chamber is vented, a pressure differential is created across the piston. This pressure differential causes the piston to slide relative to the cylinder in a first direction. Similarly, when a pressurized fluid is supplied to the second chamber and the first chamber is vented, the pressure differential created across the piston causes it to slide relative to the cylinder in a second direction. One or more fluid valves are usually used to control the supply of pressurized fluid to and the venting of the two chambers of the cylinder so as to effect movement of the piston in a desired manner.

Typically, a rod is connected to the piston for movement therewith. The rod extends outwardly from the cylinder into engagement with a workpiece. Thus, when the piston is moved within the cylinder as described above, the workpiece is moved therewith. The magnitude of the force which is generated against the workpiece is equal to the product of the pressure of the fluid in the chamber and the surface area of the piston exposed to that pressurized fluid. Thus, for example, if the magnitude of the pressurized fluid is one hundred pounds per square inch (p.s.i.) and the surface area of the piston is two square inches, then the magnitude of the force exerted by the piston against the workpiece will be two hundred pounds. Fluid actuators of this general type are commonly used in a variety of applications.

In some applications, however, the magnitude of the pressurized fluid available for use by the fluid actuator is limited. For example, in a typical manufacturing facility, pressurized air may be generated by a central supply system at a standard pressure, such as one hundred p.s.i., for the entire facility. At the same time, the magnitude of the force necessary for the fluid actuator to perform a given task may be relatively large, such as one thousand pounds. If a basic fluid actuator structure as described above were to be used to perform this task, the piston would have to very large (ten square inches in this example) in order to generate the necessary force. Obviously, it is undesirable from several standpoints to provide such a physically large piston.

To address the problem of generating relatively large forces using limited fluid pressures and relatively small pistons, it is known to modify the basic fluid actuator structure to generate an increased amount of force. These modified fluid actuator structures, which are commonly referred to as intensifiers, use multiple interacting pistons to multiply the forces produced by the pressurized fluid against the pistons, while maintaining relatively small sizes for the pistons. A typical intensifier structure includes a cylinder which is divided by an internal manifold into two working areas. In the first working area, a first piston is provided which divides the interior thereof into first and second chambers. A rod extends from the first piston through the manifold into the second working area. In the second working area, a second piston is provided which divides the interior thereof into first and second chambers.

When pressurized fluid is supplied to the first chamber of the first working area, a first force is generated against the first piston as described above. Movement of the first piston causes corresponding movement of the first rod in the first chamber of the second working area. The first chamber of the second working area is typically filled with a relatively incompressible liquid, such as oil. Thus, a second force is generated against the second piston because of the movement of the rod. The rod has a much smaller surface area than the first piston. Thus, the magnitude of the pressure generated in the first chamber of the second area against the second piston is multiplied relative to the original pressure exerted against the first piston. This multiplied pressure is applied against the surface area of the second piston and generates a multiplied force. A second rod connected to the second piston transmits the multiplied force to a workpiece.

The pistons within the intensifier maintain the separation of the air and oil. Seals are typically used around the pistons to prevent intermixing. The relatively high pressures created within the intensifier can cause a single seal to leak, undesirably allowing the air and oil to mix and reduce the efficiency of the intensifier. Dual seals having an intermediate air space are commonly used for separating the air and oil. It is preferable that the air gap should remain at atmospheric pressure throughout the entire piston stroke. A known method of maintaining atmospheric pressure in the air space is to vent the gap to atmosphere through a hole in the cylinder body located between the seals. To accomplish this, the vent hole must remain between the seals throughout the entire stroke of the piston. As a result, the seals must be separated by a sufficient distance to insure that neither seal will pass over the vent hole. Therefore, a relatively long piston must be used. It would be desirable to provide seal arrangement which seperates the air and oil within the intensifier cylinder by maintaining the pressure in an air gap between multiple seals at atmospheric pressure while using a shorter piston to decrease the size of the intensifier.

SUMMARY OF THE INVENTION

This invention relates to an improved structure for an intensifier type of fluid actuator having an improved structure for maintaining the separation of the air and oil within the intensifier. The intensifier includes a body including a first manifold connected by a first robe to a second manifold to define an intensifier chamber, a third manifold connected by a second robe to the second manifold to define a reservoir chamber, and a fourth manifold connected by a third tube to the third manifold to define a work chamber. An intensifier piston is disposed within the intensifier chamber and has an outer surface in sealing and sliding engagement with the first tube. The intensifier rod is secured to the intensifier piston and extends through the second manifold into the reservoir chamber. The intensifier rod is movable through the third manifold into the work chamber. A reservoir piston is disposed within the reservoir chamber and has an outer surface in sealing and sliding engagement with the second tube. The reservoir o piston includes a central opening formed therethrough defining an inner surface. The central opening extends from a first end of the reservoir piston adjacent to the second manifold to a second end of the reservoir piston adjacent to the third manifold. A passageway is formed in the reservoir piston-which extends from the inner surface to the outer surface thereof. A check valve assembly is disposed within the reservoir piston which permits the one-way flow of fluid from the passageway to the first end of the reservoir piston. A work piston is disposed within the work chamber and has an outer surface in sealing and sliding engagement with the third tube. A work rod is secured to the work piston which extends through the fourth manifold from the body. A plurality of ports are provided for selectively providing pressurized fluid in the intensifier chamber, the reservoir chamber, and the work chamber to selectively extend the work rod into engagement with the workpiece.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
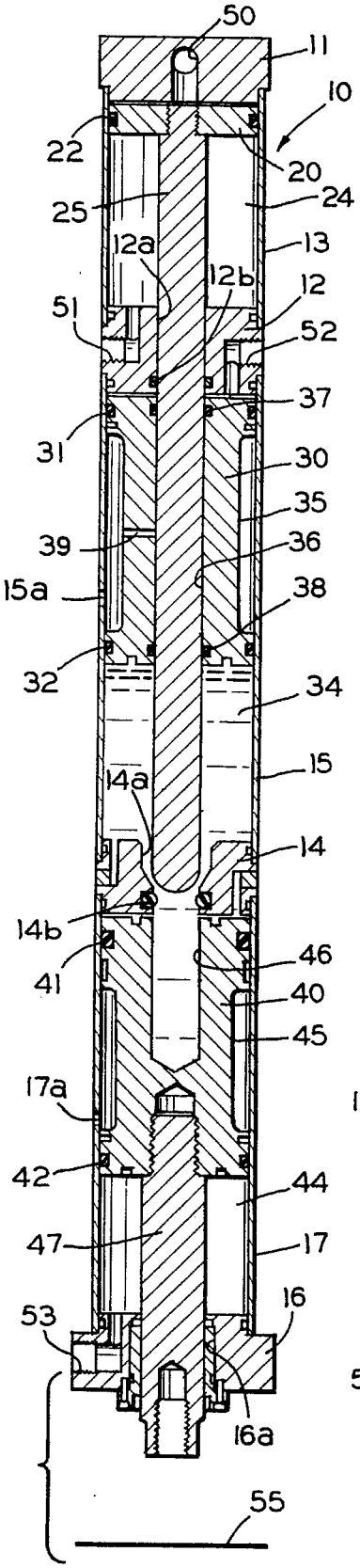
FIG. 1 (PRIOR ART)
FIG. 1 is sectional elevational view of a prior art intensifier cylinder shown in a first operating position.
Figure 2:
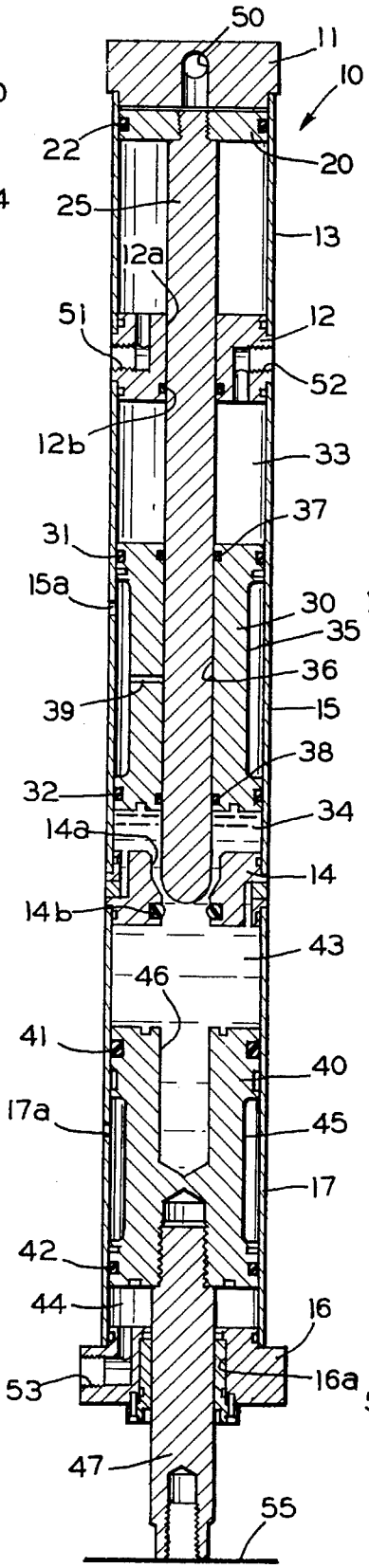
FIG. 2 (PRIOR ART)
FIG. 2 is sectional elevational view of the prior art intensifier cylinder illustrated in FIG. 1 shown in a second operation position.
Figure 3:
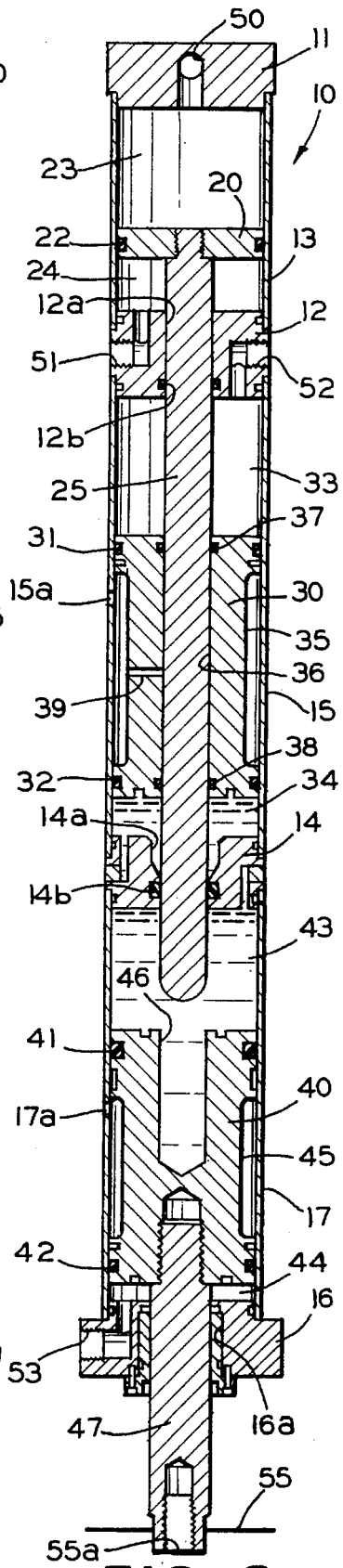
FIG. 3 (PRIOR ART)
FIG. 3 is sectional elevational view of the prior art intensifier cylinder illustrated in FIGS. 1 and 2 shown in a third operation position.

Referring now to the drawings, there is illustrated in FIGS. 1 through 3 a prior art structure for an air/oil intensifier, indicated generally at 10. The prior art intensifier 10 includes a stationary cylindrical body which provides rigid support during operation. The body of the prior art intensifier 10 includes a first manifold 11 and a second manifold 12 which are connected together by a first hollow cylindrical tube 13. As will be discussed in greater detail below, the first manifold 11, the second manifold 12, and the first tube 13 cooperate to define an intensifier chamber for the prior art intensifier 10. The body of the prior art intensifier 10 further includes a third manifold 14 which is connected to the second manifold 12 by a second hollow cylindrical tube 15. As will be discussed in greater detail below, the second manifold 12, the third manifold 14, and the second tube 15 cooperate to define an reservoir chamber for the prior art intensifier 10. The body of the prior art intensifier 10 further includes a fourth manifold 16 which is connected to the third manifold 14 by a third hollow cylindrical tube 17. As will be discussed in greater detail below, the third manifold 14, the fourth manifold 16, and the third tube 17 cooperate to define a work chamber for the prior art intensifier 10. As shown in the drawings, the internal diameters of the intensifier chamber, the reservoir chamber, and the work chamber are approximately equal.

An intensifier piston 20 is disposed within the intensifier chamber of the prior art intensifier 10 for sliding movement relative to the body thereof. The intensifier piston 20 is generally cylindrical in shape, having an annular groove formed in the outer circumferential surface thereof. A seal 22 is disposed within the groove for sealingly engaging the inner circumferential surface of the first tube 13. Thus, the intensifier piston 20 divides the intensifier chamber into an intensifier advance chamber 23 (see FIG. 3) and an intensifier return chamber 24. The intensifier advance chamber 23 is defined between the first manifold 11, the first tube 13, and the intensifier piston 20. The intensifier return chamber 24 is defined between the intensifier piston 20, the first robe 13, and the second manifold 12. An intensifier piston rod 25 is connected to the intensifier piston 20 for movement therewith. The intensifier piston rod 25 extends substantially parallel to the longitudinal axis of the body of the prior art intensifier 10, through a co-axial opening 12*a* formed through the second manifold 12, and into the reservoir chamber. A seal 12*b* provided within a groove formed in the opening 12*a* of the second manifold 12 prevents fluid communication between the intensifier chamber and the reservoir chamber.

A reservoir piston 30 is disposed within the reservoir chamber 5for sliding movement relative to the body of the prior art intensifier 10. First and second seals 31 and 32 are disposed in respective annular grooves formed in the outer circumferential surfaces of the opposed ends of the reservoir piston 30. The seals 31 and 32 sealingly engaging the inner circumferential surface of the second tube 15. Thus, the reservoir piston 30 divides the reservoir chamber into a reservoir air chamber 33 (see FIGS. 2 and 3) and an reservoir oil chamber 34. The reservoir air chamber 33 is defined between the second manifold 12, the second tube 15, and the reservoir piston 30. The reservoir oil chamber 34 is defined between the reservoir piston 30, the second tube 15, and the third manifold 14. The reservoir piston 30 is also generally cylindrical in shape, but has an enlarged recess 35 formed in the central portion of the outer circumferential surface thereof. The enlarged recess 35 defines an outer annular space between the reservoir piston 30 and the second tube 15. A co-axial bore 36 is formed through the reservoir piston 30, and the intensifier piston rod 25 extends completely through this co-axial bore 36. Seals 37 and 38 are disposed within respective grooves formed in the bore 36 for sealingly engaging the outer circumferential surface of the intensifier piston rod 25. The seals 37 and 38 define an inner annular space between the reservoir piston 30 and the intensifier piston rod 25. A radial vent bore 39 is formed through the reservoir piston 30 from the inner annular space to the outer annular space, providing for fluid communication therebetween. A Vent bore 15*a* is formed through the wall of the second tube 15. As shown in FIGS. 1, 2, and 3, the reservoir piston 30 is positioned such that vent bore 15*a* extends through and communicates with the outer annular space defined on the reservoir piston 30. Thus, both the inner annular space and the outer annular space defined by the reservoir piston 30 are vented to the atmosphere through the vent bore 15*a*. The purpose for this venting will be explained below.

A tapered or conical bore 14*a* is formed co-axially through the third manifold 14 for slidably receiving the intensifier piston rod 25. A seal 14*b* is disposed within a portion of the bore 14*a* for sealingly engaging the outer circumferential surface of the intensifier piston rod 25. The purpose for this sealing engagement will be explained below.

A work piston 40 is disposed within the work chamber of the prior art intensifier 10 for sliding movement relative to the body thereof. First and second seals 41 and 42 are disposed in respective annular grooves formed in the outer circumferential surfaces of the opposed ends of the work piston 40. The seals 41 and 42 sealingly engage the inner circumferential surface of the third tube 17. Thus, the work piston 40 divides the work chamber into a work oil chamber 43 (see FIGS. 2 and 3) and a work air chamber 44. The work air chamber 43 is defined between the third manifold 14, the third tube 17, and the work piston 40. The work air chamber 44 is defined between the work piston 40, the third tube 17, and the fourth manifold 16. The work piston 40 is also generally cylindrical in shape, but has an enlarged recess 45 formed in the central portion of the outer circumferential surface thereof. The enlarged recess 45 defines an outer annular space between the work piston 40 and the third tube 17. A co-axial counterbore 46 is formed in one end of the work piston 40. A vent bore 17*a* is formed through the wall of the third tube 15. As Shown in FIGS. 1, 2, and 3, the Work piston 40 is positioned such that vent bore 17*a* extends through and communicates with the outer annular space defined on the work piston 40 to vent it to the atmosphere. The purpose for this venting will be explained below. A work piston rod 47 is connected to the work piston 40 for movement therewith. The work piston rod 47 extends substantially parallel to the longitudinal axis of the body through a co-axial opening 16*a* formed through the fourth manifold 16 out of the prior art intensifier 10. Any one of a number of conventional tools may be connected to the end of the work piston rod 47, as is well known in the art.

The prior art intensifier 10 further includes a number of ports for effecting the operation thereof. A first port 50 is formed through the first manifold 11 and communicates with the intensifier advance chamber 23. A second port 51 is formed through the second manifold 12 and communicates with the intensifier retract chamber 24. A third port 52 is also formed through the second manifold 12 and communicates with the reservoir air chamber 33. A fourth port 53 is formed through the fourth manifold 16 and communicates with the work air chamber 44. As is well-known in the art, the ports 50, 51, 52, and 53 communicate through conventional valves (not shown) with either a source of pressurized fluid (typically pressurized air) or with the atmosphere-to effect the operation of the prior art intensifier 10.

The operation of the prior art intensifier 10 will now be described. The prior art intensifier 10 is initially disposed in the retracted position illustrated in FIG. 1. In this position, the intensifier piston 20 is disposed adjacent to the first manifold 11, the reservoir piston 30 is disposed adjacent to the second manifold 12, and the work piston 40 is disposed adjacent to the third manifold 14. As a result, the work piston rod 47 is, for the most part, retracted within the work air chamber 44. To begin an advance stroke, pressurized air is supplied through the second port 51 to the intensifier retract chamber 24 and through the third port 52 to the reservoir air chamber 33. As a result, the intensifier piston 20 is urged upwardly to maintain its position adjacent to the first manifold 11, while the reservoir piston 30 is urged downwardly toward the third manifold 14, as shown in FIG. 2 As the reservoir piston 30 advances downwardly, oil in the reservoir oil chamber 34 is displaced through the opening 14*a* into the work oil chamber 43. As a result, the work piston 40 (and the work piston rod 47 secured thereto) are also advanced downwardly until the leading end of the work piston rod 47 engages a workpiece 55. Inasmuch as there is virtually no resistance to this initial downward movement until the work piston rod 47 engages the Workpiece 55, the advance stroke of the work rod 47 occurs rapidly. FIG. 2 illustrates the positions of the various components of the prior art intensifier 10 after the completion of the advance stroke.

After the advance stroke is completed, a work stroke is initiated. To begin the work stroke, pressurized air is continued to be supplied through the third port 52 to reservoir air chamber 33. However, pressurized air is then supplied through the first port 50 to the intensifier advance chamber 23, while the intensifier retract chamber is vented to the atmosphere through the second port 51. The pressurized air in the intensifier advance chamber 23 reacts against the intensifier piston 20 to generate a first force. As a result, the intensifier piston 20 is advanced downwardly toward the second manifold 12. As the intensifier piston 20 advances, the intensifier piston rod 25 moves into through the opening 14*a* and into engagement with the seal 14*b*. When this occurs, the work oil chamber 43 is sealed, and the volume of oil contained therein is fixed. Further advancement of the intensifier piston rod 25 into the work oil chamber 43 causes a second pressure to be exerted by the oil against the work piston 40. The pressurized oil in the work oil chamber 43 reacts against the work piston 40 to generate a second force, which is greater than the first force. As a result, the work piston 40 is advanced downwardly toward the fourth manifold 16. As a result, the work rod 47 is moved with great force toward the workpiece 55. For example, if a conventional punch tool is secured to the lower end of the work piston rod 47, a cut-out 55*a* can be formed as shown in FIG. 3 at the completion of the work stroke. FIG. 3 illustrates the positions of the various components of the prior art intensifier 10 after the completion of the work stroke.

More specifically, the magnitude of the first force F 1 generated by the intensifier piston 20 is equal to the product of the magnitude of the pressurized air P 1 in the intensifier advance chamber 23 and the surface area A 1 of the intensifier piston 20. Similarly, the magnitude of the second force F2 generated by the work piston 40 is equal to the product of the magnitude of the pressurized oil P2 in the work oil chamber 43 and the surface area A2 of the work piston 40. However, the magnitude of the pressurized oil P2 in the work oil chamber 43 is equal to the magnitude of the first force F 1 exerted by the intensifier piston 20 through the intensifier piston rod 25 divided by the surface area A3 of the end of the intensifier piston rod 25 presented Within the work oil chamber 43. Consequently, the magnitude of the second force F2 generated by the work piston 40 is equal to the product of the magnitude of the first force F 1 and the surface area A2 of the work piston 40, divided by the surface area A3 of the end of the intensifier piston rod 25 presented within the work oil chamber 43. Substituting the initial calculation for the magnitude of the first force F 1, it can be seen that the magnitude of the second force F2 generated by the work piston 40 is equal to the product of (1) the magnitude of the pressurized air P 1 in the intensifier advance chamber 23, (2) the surface area A1 of the intensifier piston 20, and (3) the surface area A2 of the work piston 40, all of which divided by the surface area A3 of the end of the intensifier piston rod 25 presented within the work oil chamber 43. These calculations mathematically illustrate the force intensifying action of the prior art intensifier 10.

Because of this force intensifying mode of operation, it will be appreciated that axial downward movement of the intensifier piston rod 25 does not result in an equal amount of axial downward movement of the work piston 40. Rather, the work piston 40 moves proportionally less than the intensifier piston rod 25. Depending upon the length of the work stroke (i.e., the distance the work piston rod 47 must move), the lower end of the intensifier piston rod 25 may extend into the counterbore 46 formed in the upper end of the work piston 40. The provision of this counterbore 46 reduces the overall axial length of the prior art intensifier 10 somewhat.

To retract the work piston rod 47 within the work air chamber 44 after completion of the work stroke, the intensifier advance chamber 23 is vented to the atmosphere through the first port 50. At the same time, pressurized air is supplied through the second port 51 to the intensifier retract chamber 24, urging the intensifier piston 20 upwardly toward the first manifold 12. If desired, a second work Stroke can be performed by re-pressurizing the intensifier advance chamber 23 to further advance the work piston rod 47 downwardly. However, to retract the work piston rod 47, the reservoir air chamber 33 is vented to the. atmosphere through the third port 52, while pressurized air is supplied to the work air chamber 44 through the fourth port 53. As the work piston 47 moves upwardly, the oil in the work oil chamber 43 is displaced back into the reservoir oil chamber 34.

To insure that the inner annular space and the outer annular space defined by the reservoir piston 30 are always vented to the atmosphere through the vent bore 15*a*, the reservoir piston 30 must be formed having an axial length which is sufficiently long as to always maintain the recess 35 in communication with the vent bore 15*a*. This contributes undesirably to the overall axial length of the prior art intensifier 10.

Figure 4:
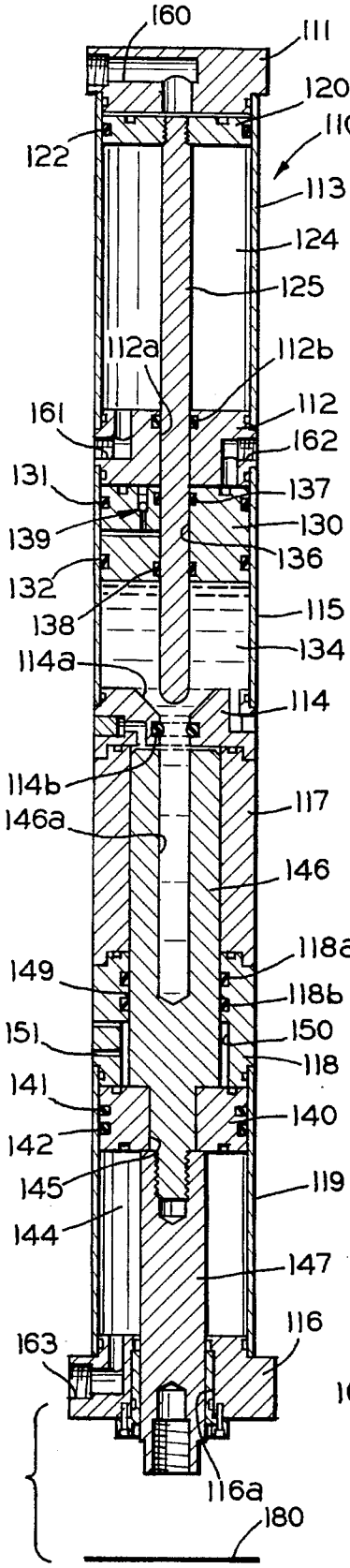
FIG. 4 is sectional elevational view of a first embodiment of an intensifier cylinder in accordance with this invention shown in a first operating position.
Figure 5:
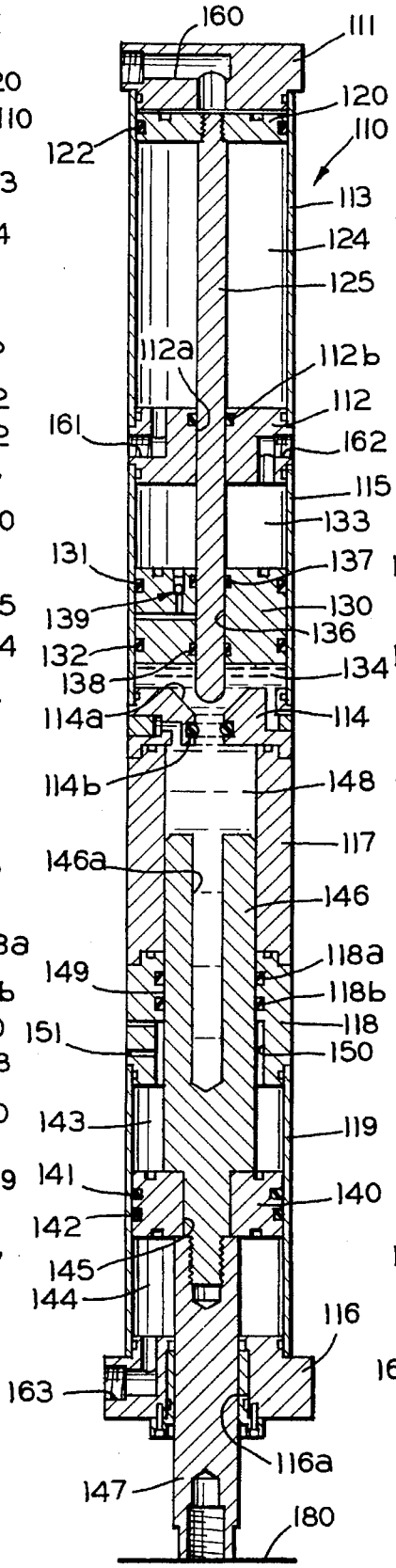
FIG. 5 is sectional elevational view of the intensifier cylinder illustrated in FIG. 4 shown in a second operation position.
Figure 6:
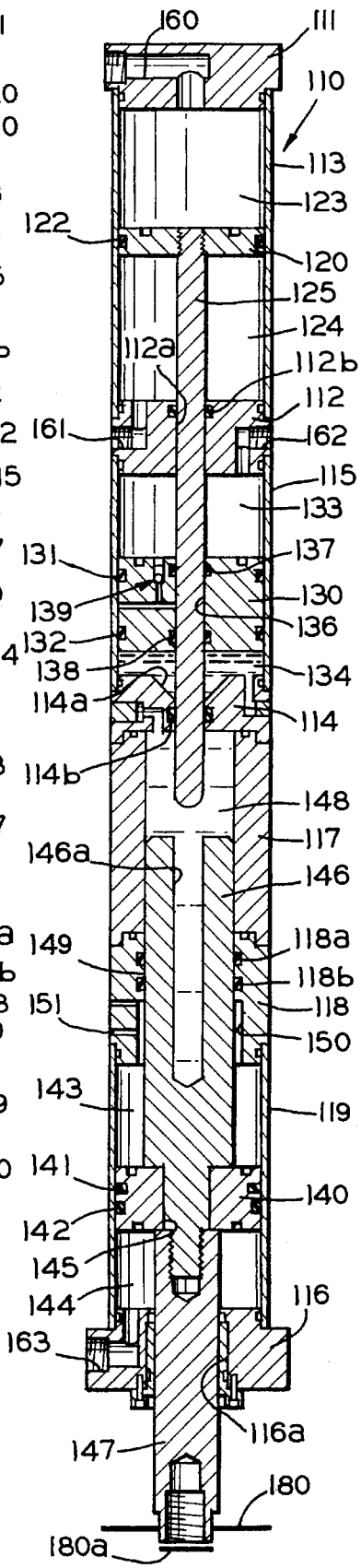
FIG. 6 is sectional elevational view of the intensifier cylinder illustrated in FIGS. 4 and 5 shown in a third operation position.

Referring now to FIGS. 4 through 6, there is illustrated an air/oil intensifier, indicated generally at 110 in accordance with this invention. The intensifier 110 includes a stationary cylindrical body which provides rigid support during operation. The body of the intensifier 110 includes a first manifold 111 and a second manifold 112 Which are connected together by a first hollow cylindrical tube 113. As will be discussed in greater detail below, the first manifold 111, the second manifold 112, and the first tube 113 cooperate to define an intensifier chamber for the intensifier 110. The body of the intensifier 110 further includes a third manifold 114 which is connected to the second manifold 112 by a second hollow cylindrical tube 115. As will be discussed in greater detail below, the second manifold 112, the third manifold 114, and the second tube 115 cooperate to define an reservoir chamber for the intensifier 110. The body of the intensifier 110 further includes a fourth manifold 116 which is connected to the third manifold 114 by a third hollow cylindrical robe 117, a is fourth hollow cylindrical tube 118, and a fifth hollow cylindrical tube 119. As will be discussed in greater detail below, the third manifold 114, the fourth manifold 116, and the third, fourth, and fifth tubes 117, 118, 119 cooperate to define a work chamber for the intensifier 110. The wall thicknesses of the third tube 117 and the fourth tube 118 are greater than the wall thickness of the first tube 113 and the second tube 115, for a reason which will be explained below.

An intensifier piston 120 is disposed within the intensifier chamber of the intensifier 110 for sliding movement relative to the body thereof. The intensifier piston 120 is generally cylindrical in shape, having an annular groove formed in the outer circumferential surface thereof. A seal 122 is disposed within the groove for sealingly engaging the inner circumferential surface of the first tube 113. Thus, the intensifier piston 120 divides the intensifier chamber into an intensifier advance chamber 123 (see FIG. 6) and an intensifier return chamber 124. The intensifier advance chamber 123 is defined between the first-manifold 111, the first tube 113, and the intensifier piston 120. The intensifier return chamber 124 is defined between the intensifier piston 120, the first tube 113, and the second manifold 112. An intensifier piston rod 125 is connected to the intensifier piston 120 for movement therewith. The intensifier piston rod 125 extends substantially parallel to the longitudinal axis of the body of the intensifier 110, through a co-axial opening 112*a* formed through the second manifold 112, and into the reservoir chamber. A seal 112*b* provided within a groove formed in the opening 112*a* of the second manifold 112 prevents fluid communication between the intensifier chamber and the reservoir chamber. A reservoir piston 130 is disposed within the reservoir chamber for sliding movement relative to the body of the intensifier 110. First and second seals 131 and 132 are disposed in respective annular grooves formed in the outer circumferential surfaces of the opposed ends of the reservoir piston 130. The seals 131 and 132 sealingly engaging the inner circumferential surface of the second tube 115. The seals 131 and 132 are preferably made from Hallite, but other suitable seal materials known in the art may be used. Thus, the reservoir piston 130 divides the reservoir chamber into a reservoir air chamber 133 (see FIGS. 5 and 6) and an reservoir oil chamber 134. The reservoir air chamber 133 is defined between the second manifold 112, the second robe 115, and the reservoir piston 130. The reservoir oil chamber 134 is defined between the reservoir piston 130, the second tube 115, and the third manifold 114. The reservoir piston 130 is generally cylindrical in shape, having a co-axial bore 136 formed therethrough. The intensifier piston rod 125 extends completely through this co-axial bore 136. Seals 137 and 138 are disposed within respective grooves formed in the bore 136 for sealingly engaging the outer circumferential surface of the intensifier piston rod 125. The seals 137 and 138 define an inner annular space between the reservoir piston 130 and the intensifier piston rod 125. A check valve assembly, indicated generally at 139 in FIGS. 4, 5, and 6 is provided within the reservoir piston 130. The structure and operation of the check valve assembly 139 will be explained in detail below.

A tapered or conical bore 114*a* is formed co-axially through the third manifold 114 for slidably receiving the intensifier piston rod 125. A Seal 114*b* is disposed within a portion of the bore 114*a* for sealingly engaging the outer circumferential surface Of the intensifier piston rod 125. The purpose for this sealing engagement will be explained below.

A work piston 140 is disposed within the work chamber of the intensifier 110 for sliding movement relative to the body thereof. First and second seals 141 and 142 are disposed in respective annular grooves formed in the outer circumferential surfaces of the opposed ends of the work piston 140. The seals 141 and 142 sealingly engage the inner circumferential surface of the fifth tube 119. Thus, the work piston 140 divides the work chamber into an upper work chamber 143 (see FIGS. 5 and 6) and a lower work chamber 144. The upper work chamber 143 is defined between the third manifold 114, the tubes 117, 118, 119, and the work piston 140. The lower work chamber 144 is defined between the work piston 140, the tubes 117, 118, 119, and the fourth manifold 116. The work piston 140 is generally cylindrical in shape, having a co-axial bore 145 formed therethrough.

An upper cylindrical extension 146 and a lower work piston rod 147 are connected to the work piston 140 for movement therewith. The extension 146 extends substantially parallel to the longitudinal axis of the body of the intensifier 110 through the fourth tube 118 and the third tube 17. First and second static seals 118*a* and 118*b* are disposed in respective annular grooves formed in the inner surface of the fourth tube 118. The seals 118*a* and 118*b* are static seals because they are located in the stationary walls of the fourth tube 118, rather than in the moving work piston 40 of the prior art intensifier 10 described above. The static seals 118*a* and 118*b* engage the extension 146 so as to defined an upper work oil chamber 148 (see FIGS. 5 and 6) which is separate from the remainder of the upper work chamber 143. A first radial vent bore 149 is formed through the fourth tube 118 extending from the annular space defined between the static seals 118*a* and 118*b* to the exterior of the fourth tube 118. The first radial vent bore 149 maintains the air pressure in this annular space at atmospheric pressure. A co-axial counterbore 146*a* is formed in the upper end of the extension 146 for a purpose which will be explained below.

The work piston rod 147 extends substantially parallel to the longitudinal axis of the body of the intensifier 110 through a co-axial opening 116*a* formed through the fourth manifold 116 out of the intensifier 110. Any one of a number of conventional tools may be connected to the end of the work piston rod 147, as is well known in the art. An annular recess 150 is formed in the inner Surface of the fourth tube 118 which extends downwardly from the static seals 118*a* and 118*b* toward the fifth tube 119. A second radial vent bore 151 is formed through the fourth tube 118 from the annular space defined by the recess 150 to the exterior of the fourth tube 118. The second radial vent bore 15 1 vents the remainder of the upper work chamber 143 to the atmosphere so as to prevent movement of the work piston 140 from being impeded.

The intensifier 110 further includes a number of ports for effecting the operation thereof. A first port 160 is formed through the first manifold 111 and communicates with the intensifier advance chamber 123. A second port 161 is formed through the second manifold 112 and communicates with the intensifier retract chamber 124. A third port 162 is also formed through the second manifold 112 and communicates with the reservoir air chamber 133. A fourth port 163 is formed through the fourth manifold 116 and communicates with the lower work chamber 144. As is well known in the art, the ports 160, 161, 162 and 163 communicate through conventional valves (not shown) with either a source of pressurized fluid (typically pressurized air) or with the atmosphere to effect the operation of the intensifier 110.

Figure 7:
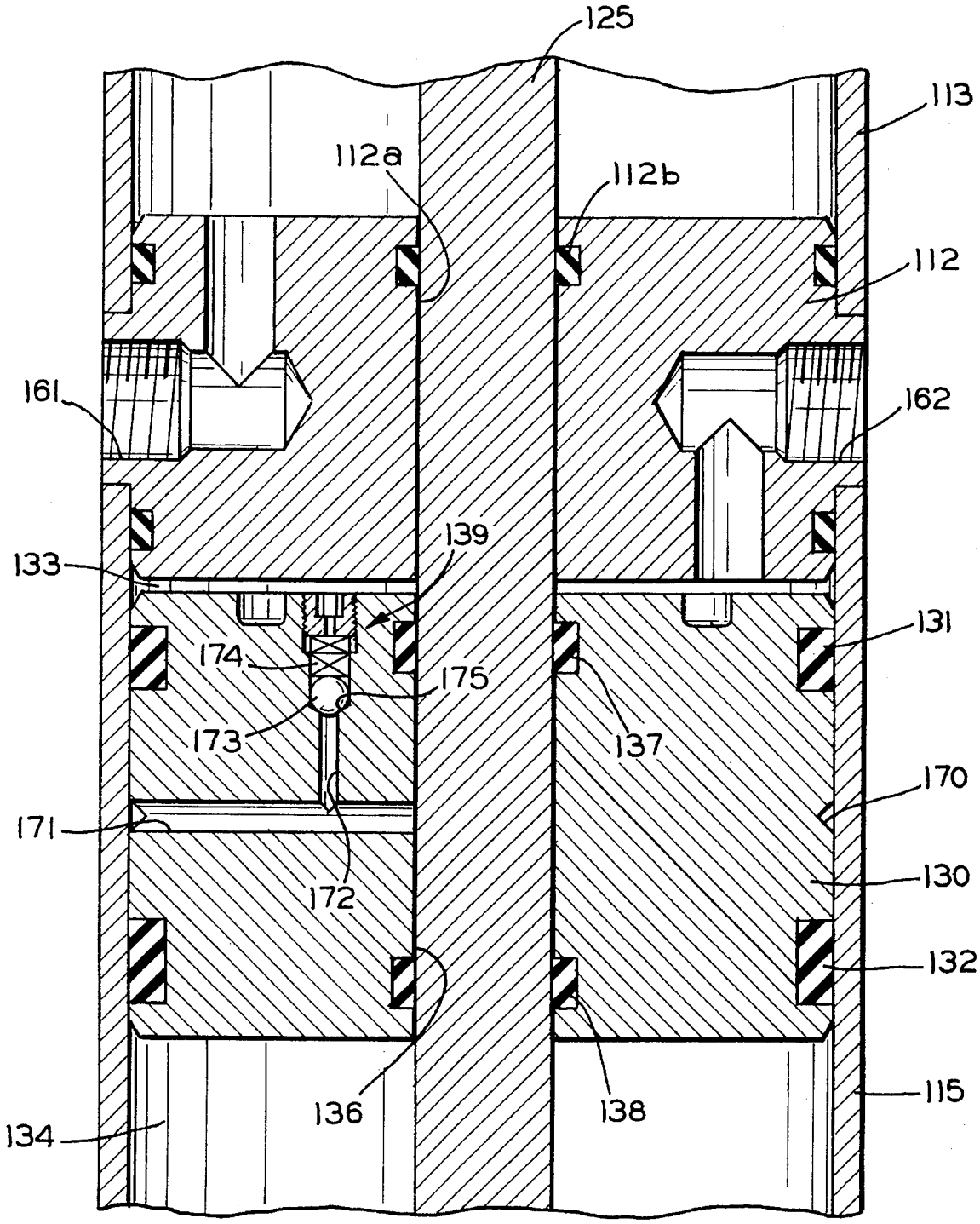
FIG. 7 is an enlarged sectional elevational view of the reservoir piston illustrated in FIGS. 4, 5, and 6.

Referring now to FIG. 7, the structure Of the reservoir piston 130 is illustrated in detail. As shown therein, the check valve assembly 139 includes an annular groove 170 which is formed in the outer circumferential surface of the reservoir piston 130. A radial bore 171 is formed through the reservoir piston 130 extending from the annular groove 170 to the co-axial bore 136. A stepped axial bore 172 is formed also formed through the reservoir piston 130 extending from the radial bore 171 to the end of the reservoir piston 130 adjacent to the second manifold 112. A ball 173 is biased downwardly by the lower end of a spring 174 into sealing engagement with a valve seat 175 defined within the stepped axial bore 172. The upper end of the spring reacts against a threaded plug 176 which is secured within the upper end of the stepped axial bore 172 to normally maintain the ball 173 in such sealing engagement with the valve seat 175, thereby permitting the one-way flow of fluid through the check valve assembly 139 from the radial bore 171 to the reservoir air chamber 133. The ball 173 can be made of rubber or other suitable materials used for check elements which are known in the art. Although the illustrated ball-type check valve assembly 139 is preferred, the check valve assembly 139 may be embodied as any other check valve structure which is known in the art.

The operation of the intensifier 110 will now be described. The. intensifier 110 is initially disposed in the retracted position illustrated in FIG. 4. In this position, the intensifier piston 120 is disposed adjacent to the first manifold 111, the reservoir piston 130 is disposed adjacent to the second manifold 112, and the extension 146 connected to the work piston 140 is disposed adjacent to the third manifold 114. As a result, the workpiston rod 147 is, for the most part, retracted within the lower work chamber 144. To begin an advance stroke, pressurized air is supplied through the second port 161 to the intensifier retract chamber 124 and through the third port 162 to the reservoir air chamber 133. As a result, the intensifier piston 120 is urged upwardly to maintain its position adjacent to the first manifold 111, while the reservoir piston 130 is urged downwardly toward the third manifold 114, as shown in Fig, 5. As the reservoir piston 130 advances, downwardly, oil in the reservoir oil chamber 134 is displaced through the opening 114*a* into the upper work oil chamber 148. As a result, the extension 146, the work piston 140, and the work piston rod 147 secured thereto are also advanced downwardly until the leading end of the work piston rod 147 engages a workpiece 180. Inasmuch as there is virtually no resistance to this initial downward movement until the work piston rod 147 engages the workpiece 180, the advance stroke of the work rod 147 occurs rapidly. FIG. 5 illustrates the positions of the various components of the intensifier 110 after the completion of the advance stroke.

After the advance stroke is completed, a work stroke is initiated. To begin the work stroke, pressurized air is continued to be supplied through the third port 162 to reservoir air chamber 133. However, pressurized air is then supplied through the first port 160 to the intensifier advance chamber 123, while the intensifier retract chamber 124 is vented to the atmosphere through the second port 161. The pressurized air in the intensifier advance chamber 123 reacts against the intensifier piston 120 to generate a first force. As a result, the intensifier piston 120 is advanced downwardly toward the second manifold 112. As the intensifiers piston 120 advances, the intensifier piston rod 125 moves into through the opening 114*a* and into engagement with the seal 114*b*. When this occurs, the upper work oil chamber 148 is sealed, and the volume of oil contained therein is fixed. Further advancement of the intensifier piston rod 125 into the upper work oil chamber 148 causes a second pressure to be exerted by the oil against the extension 146 of the work piston 140. The pressurized oil in the upper work oil chamber 148 reacts against the extension 146 to generate a second force, which is greater than the first force. As a result, the work piston 140 is advanced downwardly toward the fourth manifold 116. As a result, the work rod 147 is moved with great force toward the workpiece 180. For example, if a conventional punch tool is secured to the lower end of the work piston rod 147, a cut-out 180*a* can be formed as shown in FIG. 6 at the completion of the work stroke. FIG. 6 illustrates the positions of the various components of the intensifier 110 after the completion of the work stroke.

To retract the work piston rod 147 within the lower work chamber 144 after completion of the work stroke, the intensifier advance chamber 123 is vented to the atmosphere through the first port 160. At the same time, pressurized air is supplied through the second port 161 to the intensifier retract chamber 124, urging the intensifier piston 120 upwardly toward the first manifold 112. If desired, a second work stroke can be performed by repressurizing the intensifier advance chamber 123 to further advance the work piston rod 147 downwardly. However, to retract the work piston rod 147, the reservoir air chamber 133 is vented to the atmosphere through the third port 162, while pressurized air is supplied to the lower work chamber 144 through the fourth port 163. As the work piston 147 moves upwardly, the oil in the upper work oil chamber 148 is displaced back into the reservoir oil chamber 134.

As discussed above, the advance stroke is initiated by supplying pressurized air through the third port 162 to reservoir air chamber 133. As a result, the reservoir piston 130 is urged downwardly from the position illustrated in FIGS. 4 and 7 toward the third manifold 114, as shown in FIG. 5. When pressurized air is supplied through the third port 162 to reservoir air chamber 133, the check valve assembly 139 is closed because the ball 173 is urged into sealing engagement with the valve seat 175 under the urging of the spring 174. Consequently, none of the pressurized air in the reservoir air chamber 133 can escape through the reservoir piston 130. When it is desired to retract the work piston 147, the reservoir air chamber 133 is vented to the atmosphere through the third port 162, as also discussed above. The check valve assembly 139 functions to maintain the pressure of the air located in the axial bore 172 and the radial bore 171 at atmospheric pressure, thereby preventing the accumulation of fluid pressure therein as a result of the reciprocating axial movement of the reservoir piston 130. As discussed above, the radial bore 171 extends from the outer annular space defined by the inner surface of the third tube 115, the outer surface of the reservoir piston 130, and the two seals 131 and 132 to the inner annular space defined by the inner surface of the reservoir piston 130, the outer surface of the intensifier piston rod 125, and the seals 137 and 138. Consequently, the pressure of the air located in this annular spaces are also maintained at atmospheric pressure. This structure provides a significant reduction in the axial length of the intensifier 110 in comparison to the prior art intensifier 10 discussed above. Also, it has been found that the air volume requirements for the operating the intensifier 110 are reduced in comparison to the prior art intensifier 10 because the extension 146 presents a smaller surface area than the prior art work piston 47 to the pressurized oil. By using a smaller diameter extension 146, the reservoir piston 130 does not have to move as far to move the work piston rod 147 the same predetermined distance as in the prior art intensifier 10. Lastly, by providing a smaller surface area on the extension 146, the force exerted by the work piston rod 147 during the advance stroke will be less than the prior art intensifier 10. This provides a "soft touch " engagement of the tool mounted on the end of the work piston rod 147 with the workpiece 180, reducing noise and prolonging the life of the tool.

Figure 8:
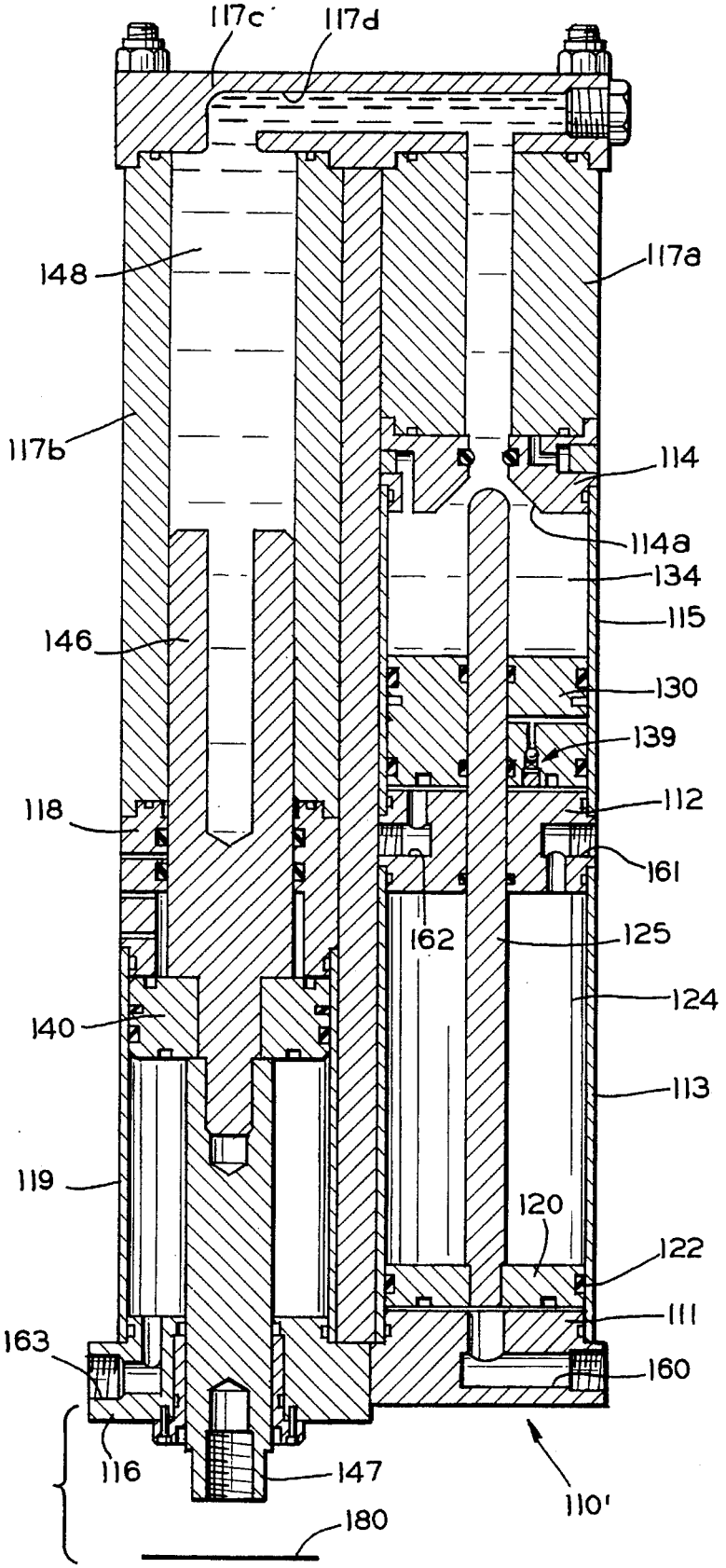
FIG. 8 is a sectional elevational view of a second embodiment of an intensifier cylinder in accordance with this invention.

FIG. 8 illustrates an alternate embodiment of an intensifier 110' in accordance with this invention. The alternate intensifier 110' is, in large measure, identical to the intensifier 110 described above, and like reference numbers are used to indicate corresponding components. Rather than being fully linear, however, the alternate intensifier 110' is folded upon itself to reduce the overall axial length thereof. To accomplish this, the third tube 117 of the intensifier 110 is divided into two third tube sections 117*a* and 117*b* which communicate with one another through an end cap 117*c* having a generally U-shaped passageway 117*d* formed therethrough. The structure and operation of the alternate intensifier 110' is otherwise identical to the intensifier 110. described above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An air/oil intensifier comprising:

a body including a first manifold connected by a first tube to a second manifold to define an intensifier chamber, a third manifold connected by a second tube to said second manifold to defined a reservoir chamber, and a fourth manifold connected by a third tube to said third manifold to define a work chamber;

an intensifier piston disposed within said intensifier chamber and having an outer surface in sealing and sliding engagement with said first tube, an intensifier rod being secured to said intensifier piston and extending through said second manifold into said reservoir chamber, said intensifier rod being movable through said third manifold into said work chamber;

a reservoir piston disposed within said reservoir chamber and having an outer surface in sealing and sliding engagement with said second tube, said reservoir piston including a central opening formed therethrough defining an inner surface, said central opening extending from a first end of said reservoir piston adjacent to said second manifold to a second end of said reservoir piston adjacent to said third manifold, a passageway being formed in said reservoir piston which extends from said inner surface to said outer surface, a check valve being disposed within said reservoir piston which permits the one-way flow of fluid from said passageway to said first end of said reservoir piston;

a work piston disposed within Said work chamber and having an outer surface in sealing and sliding engagement with said third tube, a work rod being secured to said work piston, said work rod extending through said fourth manifold from said body; and means for selectively providing pressurized fluid in said intensifier chamber, said reservoir chamber, and said work chamber to selectively extend said work rod into engagement with the workpiece.

2. The air/oil intensifier defined in claim 1 wherein said reservoir piston includes a body which defines said outer surface, said body extending from said first end to said second end, said body having said central opening formed therethrough which defines said inner surface.

3. The air/oil intensifier defined in claim 2 further including a first outer seal provided on said outer surface of said reservoir piston adjacent to said first end and a second outer seal provided on said outer surface of said reservoir piston adjacent to said second end.

4. The air/oil intensifier defined in claim 3 further including a first inner seal provided on said inner surface of said reservoir piston adjacent to said first end and a second inner seal provided on said inner surface of said reservoir piston adjacent to said second end.

5. The air/oil intensifier defined in claim 1 wherein said check valve is disposed in a check valve passageway extending from said passageway to said first end of said reservoir piston.

6. The air/oil intensifier defined in claim 5 wherein said check valve passageway is formed having a step.

7. The air/oil intensifier defined in claim 6 wherein said check valve includes a ball which is resiliently biased into sealing engagement with said step.

8. The air/oil intensifier defined in claim 7 further including a spring for resiliently biasing said ball into sealing engagement with said step.

9. The air/oil intensifier defined in claim 1 wherein said work chamber defines an inner dimension which is smaller than an inner dimension defined by said intensifier chamber.

10. The air/oil intensifier defined in claim 1 wherein said work chamber defines an inner dimension which is smaller than an inner dimension defined by said reservoir chamber.

11. The air/oil intensifier defined in claim 1 wherein said work piston is formed having a counterbore in one end thereof, and wherein said intensifier rod is extendible into said counterbore.

12. The air/oil intensifier defined in claim 1 wherein said intensifier chamber, said reservoir chamber, and said work chamber are axially aligned.

13. The air/oil intensifier defined in claim 1 wherein said intensifier chamber and a portion of said reservoir chamber are aligned with a first axis, and wherein a portion of said work chamber are aligned with a second axis.

14. A reservoir piston adapted for use in an air/oil intensifier comprising:

a body defining an outer surface and extending from a first end to a second end, said body having a central opening formed therethrough defining an inner surface;

a first outer seal provided on said outer surface adjacent to said first end and a second outer seal provided on said outer surface adjacent to said second end;

a first inner seal provided on said inner surface adjacent to said first end and a second inner seal provided on said inner surface adjacent,to said second end;

a passageway formed in said body and extending from said inner surface to said outer surface; and a check valve disposed within said body and permitting the one-way flow of fluid from said passageway to said first end of said body.

* * * * *